US010780337B2

(12) United States Patent
Thomas

(10) Patent No.: US 10,780,337 B2
(45) Date of Patent: Sep. 22, 2020

(54) IN-MOUTH FILTER AGAINST INSECTS AND PARTICULATES

(71) Applicant: George Reuben Thomas, London (CA)

(72) Inventor: George Reuben Thomas, London (CA)

( * ) Notice: Subject to any disclaimer, the term of this patent is extended or adjusted under 35 U.S.C. 154(b) by 2 days.

(21) Appl. No.: 15/963,112

(22) Filed: Apr. 26, 2018

(65) Prior Publication Data

US 2019/0329120 A1 Oct. 31, 2019

Related U.S. Application Data

(60) Provisional application No. 62/464,915, filed on Feb. 28, 2017.

(51) Int. Cl.
*A63B 71/08* (2006.01)
*A62B 23/00* (2006.01)

(52) U.S. Cl.
CPC ..... *A63B 71/085* (2013.01); *A62B 23/00* (2013.01); *A63B 2071/086* (2013.01)

(58) Field of Classification Search
CPC .. A62B 23/00; A63B 2071/086; A63B 71/085
USPC ..... 128/859–861, 206.12, 206.16, 206.17
See application file for complete search history.

(56) References Cited

U.S. PATENT DOCUMENTS 712,304 A 10/1902 Jacobs
893,213 A 7/1908 Whiteway
2,928,388 A * 3/1960 Jaroslaw ..... A41D 13/1176 128/206.14
4,169,473 A * 10/1979 Samelson ..... A61F 5/566 128/848
D325,780 S * 4/1992 Policappelli ..... D24/162
5,386,825 A 2/1995 Bates
5,533,523 A * 7/1996 Bass, Jr. ..... A61M 16/0488 128/859
7,025,060 B1 * 4/2006 Nicholson ..... A62B 23/06 128/206.17
2004/0007234 A1 * 1/2004 Duxbury ..... A62B 23/06 128/205.27
2006/0225738 A1 * 10/2006 Afentoulopoulos ..... A62B 7/10 128/205.27
2007/0028926 A1 * 2/2007 Kotani ..... A61F 5/566 128/848

(Continued)

FOREIGN PATENT DOCUMENTS

AU WO2007002979 A1 1/2007
CA 2529673 A1 10/2006

(Continued)

*Primary Examiner* — Kristen Matter

(57) ABSTRACT

An in-mouth barrier against entry of insects, pollen and particulates in to the open mouth of a user, particularly in strenuous outdoor exercises, needs to be comfortable and fully effective for various extents of an agape mouth, and ideally should require no conscious effort to re-position in even long durations. A filter frame surrounding a screen is formed to the dental arch so as to envelope both rows of teeth except possibly the molars. A flange on the frame holds the frame on the mandibular teeth and prevents the frame from moving down. The end of the flange lies under the tip of the tongue and prevents the frame from moving up. The frame thus remains comfortably inside the vestibule and covers the mouth for the various extents it may be opened to.

3 Claims, 7 Drawing Sheets

(56) References Cited

U.S. PATENT DOCUMENTS

2013/0074850 A1* 3/2013 Lenart ..... A63B 71/085
128/861

FOREIGN PATENT DOCUMENTS

DE 102004025905 B3 * 11/2005 ..... A41D 13/11
KR WO2013094806 A1 6/2013

* cited by examiner

IN-MOUTH FILTER AGAINST INSECTS AND PARTICULATES

FIELD

The present invention relates to protective equipment, and more particularly to a breathing filter positioned inside the mouth and preventing entry of insects, pollen and particulates when the user's mouth is open to various extents.

BACKGROUND

Prolonged strenuous outdoor activities like long-distance biking and running require greater intake of oxygen. Consequently, the individual's mouth becomes open in various extents that are commensurate with the required increases in the quantity of air intake, and insects and airborne particulates hitch ride into the mouth. There have been devices to address this problem, but none that allows mouth to be open not only to one extent but also any extent that happens to be just right at the moment and fits fully inside the mouth behind open as well as closed lips.

U.S. Pat. No. 7,025,060 issued to Nicholson discloses a disposable breathing filter retained in the mouth by the user's lips or teeth. The device is comprised of a rearward part inserted in the mouth and a forward part containing a filter and a central tube. The forward part positions outside the mouth. The device is meant for protection in work places with air contamination. The restriction of exhaling through a small tube and inhaling through an assembly of filters renders it unsuitable for wearing in strenuous exercises where relatively higher volumes of air are inhaled and exhaled. Moreover, in this device the mouth has to be open in a fixed position, namely for teeth to grip the rearward part, as opposed to the need particularly in strenuous long-duration outdoor exercises to have mouth open in various extents.

Canada Patent Application CA 2529673, since abandoned; in the name of Afentoulopoutos describes an in-mouth filtration apparatus. It is comprised of a curved surface positioned beneath the user's lips and a more or less cylindrical filter insert attached rearward from the surface and gripped by the teeth. The filtering material in the filter insert allows the passage of air while preventing the passage of particles. The curved surface retained beneath the lips enables air to flow only through the filter insert. The device is not suitable for wearing in strenuous exercises, firstly due to the restriction of inhaling and exhaling through the fitter in a small tube not allowing the relatively large volume of air exchange required in strenuous exercises, and secondly for not allowing for user mouth needing to be open in various extents.

U.S. Pat. No. 712,304 issued to Jacobs and Black discloses a filter with a curved profile to mimic the outside of a mouth and a strip of rubber secured to the center of the filter. The device is placed over user's mouth and retained in position by gripping the rubber strip. This device needs the mouth to be closed for the gripping so that the breathing is through the combination of the filter and the teeth of the closed mouth. This is not suitable for wearing in strenuous outdoor activities where the mouth needs to be open in various extents.

U.S. Pat. No. 893,213 issued to Whiteway discloses a respirator which is a filter comprising a screen surface in an oblong frame surrounding the lips and with two fingers at opposite ends of the frame, each finger ending in an oval or round disk. The fingers with the disks are inserted in the user's mouth between the outer side of the teeth and the inner side of the cheeks and the natural pressure of the cheeks against the teeth is said to hold the respirator in place with the fitter outside the mouth and allowing breathing. This device does seem to allow the mouth to be open in various extents. However, in the violence of strenuous long-duration outdoor exercises, the fingers and disks are likely to irritate the gums if not the inner side of the cheeks.

U.S. Pat. No. 5,389,825 issued to Bates discloses a respiratory breathing filter apparatus that conforms with the user's mouth, and is engaged by the teeth without use of the user's hands. It comprises a plurality of one-way valves and two fitter media for removing coarse and fine particles respectively. While this might be suitable for administering certain medications to the inhaled air, it is too substantial for use as an exercise filter, nor does it allow the mouth to be open in various extents.

U.S. Pat. No. 5,771,885 issued to Putrello discloses an exercise filter assembly that is shaped in the form of a wall to fit between the user's teeth and lips. Extending inwardly from opposite ends of the wall are a pair of members for fitting between upper and lower teeth to allow a person to bite thereon to hold the mouthpiece. This device is too substantial for strenuous long-duration outdoor exercises and also does not allow for mouth to be open in various extents.

WO2013094806 in the name of Kim and Seo discloses a respirator worn over both mouth and nose. It is a mask comprised of two sections; a first section that fits snugly over both the mouth and nose and a second section containing the filter element removably coupled to the first section. A soft tube from the second section passes through the first section; this tube is gripped by the user's teeth. This device is not suitable where relatively large volumes of air are needed in the breathing as in strenuous exercising, nor does it allow for mouth to be open in various extents.

U.S. Pat. No. 6,584,975 issued to Taylor discloses a respirator mask for filtering breathed air. It comprises a mouthpiece portion removably coupled to a mask portion. A tube functioning between the two parts has its one end positionable in the user's mouth. Although there are no specifications given on how this tube is positioned in the mouth it is clear that for breathing to take place the tube must communicate with the oral cavity. That means the tube must be gripped by the teeth. While this is suitable in the context where the device is the preferred mode, it does not allow for mouth to be open in various extents as would be natural in strenuous long-duration outdoor exercises.

Patent Application Pub. No. WO2007/002979 in the name of Dellal, Robair and Wartan discloses a face mask that fits tightly around the mouth with the teeth and lips gripping or lips alone gripping a tube issuing from a filter in front of the mouth to filter the inhaled air. This device, with the restriction of air ingress through tube may not be adequate for the violence of strenuous long-duration outdoor exercises requiring large volumes of air nor does it allow for mouth to be open in various extents.

While the prior art might suit the particular contexts where they fill need, we have seen in each that it does not suit the main context of the present invention, namely the context of allowing the mouth to be open in all the various extents, free and easy flow of large volumes air through the mouth, and effortless, comfortable, and unobtrusive retention inside the mouth.

SUMMARY OF THE INVENTION

The present invention is an in-mouth filter comprising a frame conforming to the dental arch, with a central opening and a screen-like surface covering the opening, allowing flow of air but not insects, pollen or particulates when the user's mouth is agape to various extents The device rests in the vestibule, namely the space inside a user's lips but outside the teeth.

In one embodiment, the device is a flat frame surrounding a screen. A flat projecting portion or flange, generally no wider than the combined lengths of the mandibular incisal edges, projects from the center of a long edge of the frame to a height that is more or less equal to one-half the average height of the mandibular incisors of an adult whose gums have not started receding. The flange then proceeds a short distance perpendicularly thereby producing a first bend resulting in the end of the flange facing away from the frame. The end of the flange then bends back, which is the second bend, so that the two bends produce a U. The flange then proceeds more or less beyond the frame and then continues in a smooth arch over a short distance away from the frame. The flange then continues for an additional distance that is more or less equal to the distance from the center of the said smooth arch to the first bend. The frame and the screening surface are bent, unless the already so formed, to conform to the contour of the two dental arches. The frame, engaged by the first bend of the flange, is positioned over both rows of teeth but just inside the upper and lower lips. In this manner, the frame extends into the buccal folds superiorly and interiorly of the cheek without pressure on the muscles of the cheek or the skin of the interior of the cheeks or the exterior of the gums. The inwardly projecting flange engaged by the mandibular incisors prevents the in-mouth filter from sliding lower while the tip of the tongue prevents the device from moving higher and disengaging from the mandibular incisors. The mandibular incisors, lips, cheeks, and tongue cooperate in keeping the in-mouth filter aligned symmetrically with respect to the midline of the lower dental arch; this results in the screening surface continuing to occupy and cover the opening of the mouth for the various extents the mouth may be opened to without having to be adjusted by hand.

In another embodiment, one long side of the frame is a bite-guard for the mandibular teeth while the other long side is not necessarily a bite-guard but is positioned as before over the maxillary teeth. In this embodiment there is no need for a flange to engage the mandibular incisors; instead the flange starts out in a direction away from the frame from the center of the side near the bottom of the bite-guard, continues in a smooth arch and then proceeds to an end as in the embodiment described above.

These and other features, aspects and other advantages of the present invention will become better understood from the following drawings and description.

DETAILED DESCRIPTION OF THE INVENTION

The following description of the preferred embodiment(s) is merely exemplary in nature to illustrate the general principles of the invention and is in no way intended to limit the invention, its application, or uses.

Figure 1:
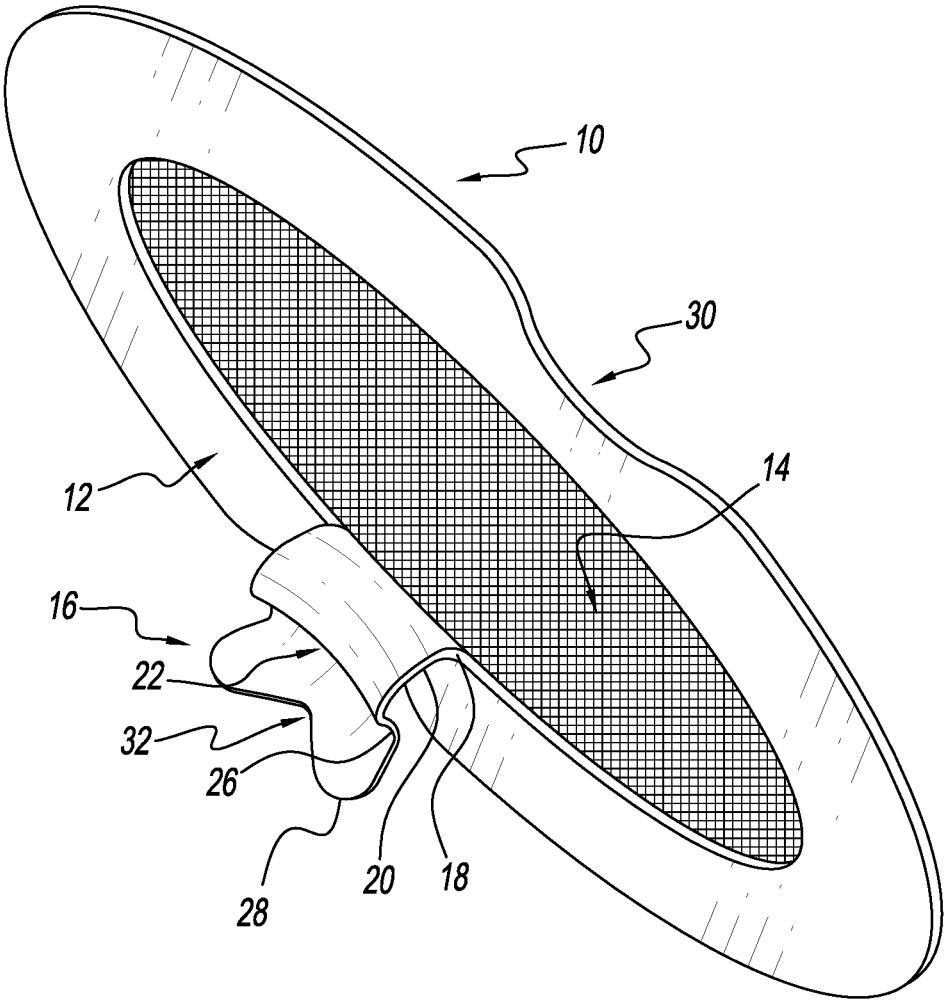
FIG. 1 is a perspective view of an in-mouth filter according to an exemplary embodiment of the present invention.

Referring now to the figures, in FIG. 1 is shown an in-mouth filter according to an exemplary embodiment of the invention. The in-mouth filter 10 includes a frame 12 that can be smoothly bent to fit around a user's dental arch so as to lie in the vestibule over the gums except possibly the portions of the gums beside the molars. The frame 12 has a centrally located depression 30 on both outer edges of it. The depressions are not necessarily of the same depth or shape.

Referring to FIG. 1, there is shown an in-mouth filter 10 having a frame 12 around a screen, or a surface 14 with holes, and a flange 16 proceeding from the frame 12.

In further detail, referring to FIG. 1, the flange 16, generally no wider than the combined lengths of the average mandibular incisel edges, rises from an inner edge adjacent to one of the two depressions 30 of the frame.

Figure 2:
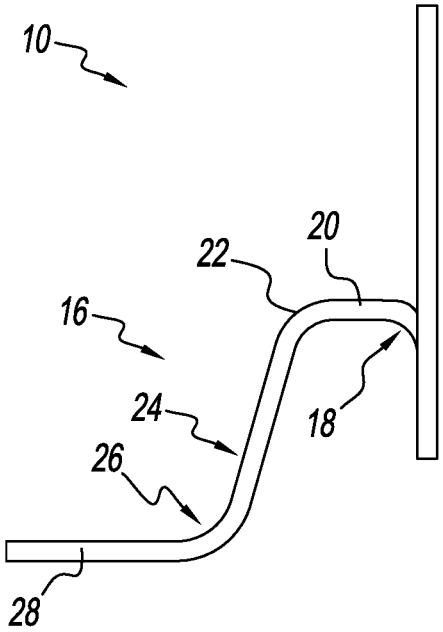
FIG. 2 is a side view of the in-mouth filter of FIG. 1.
Figure 3:
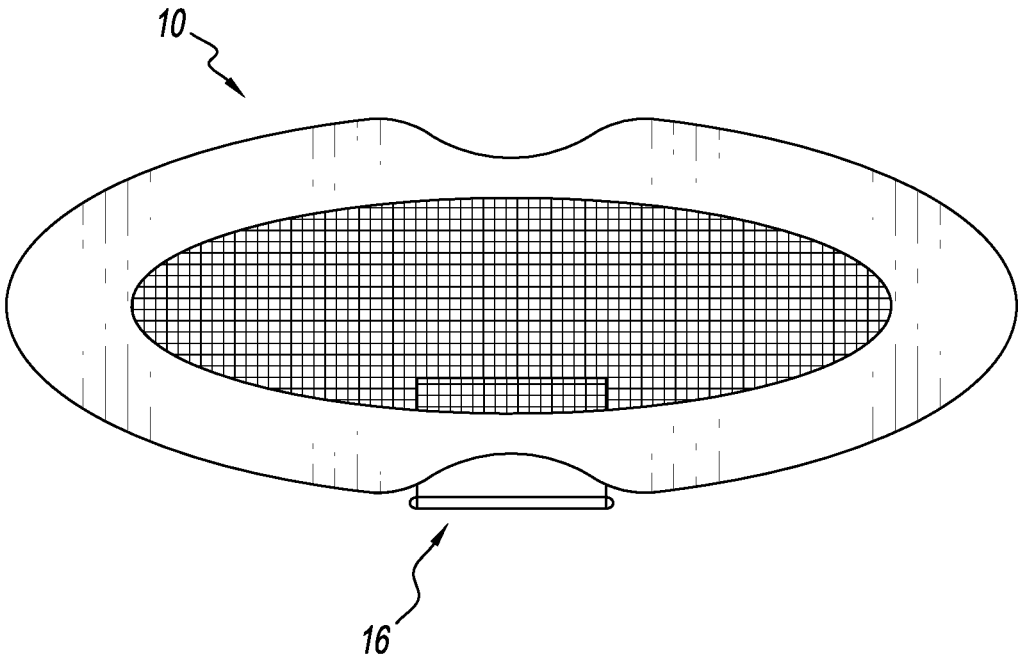
FIG. 3 is a front view of the in-mouth filter of FIG. 1.

Referring now to FIG. 2, which is a side view of the in-mouth filter 10, the flange rises to a height above the frame, which height is more or less equal to one-half the height of an average size adult mandibular incisor. The flange then proceeds more or less perpendicularly to form the bend 18. The flange now proceeds through a distance that is greater than the average thickness of mandibular incisor edges to form the element 20 and then smoothly curves downward, producing a bend 22.

Referring to FIG. 2, the flange 16 proceeds now from element 22 in a downward direction more or less beyond the frame 12 to form element 24. The flange 16 then continues in a smooth bend 26. The flange then proceeds a distance more or less equal to the distance between the centers of the elements 22 and 26 and forms element 28 which is more or less in a direction perpendicular to the frame 12.

Referring to FIG. 1, the element 28 has an indent 32 at its end.

Figure 8:
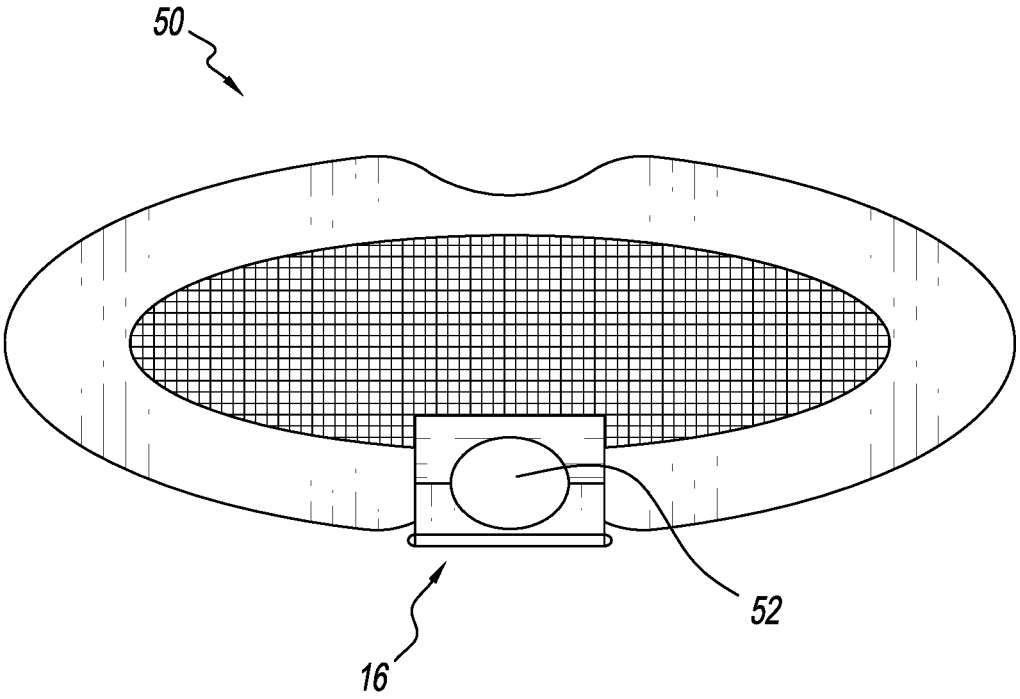
FIG. 8 is a back view of the in-mouth fitter of FIG. 1, showing an alternative embodiment by virtue of having an oval hole.

FIG. 8 is another embodiment 50 of the invention, wherein the flange 16 of FIG. 1 has a hole 52 in the element 24 of FIG. 2 to accommodate the tip of the tongue.

In yet another embodiment of the invention, wherein one long side of the frame 12 is a bite-guard for the mandibular teeth while the other long side is not necessarily a bite-guard but is positioned as before over the maxillary teeth. In this embodiment there is no need for a flange to engage the mandibular incisors; instead the flange starts out from the inner side of the bite-guard, descends in a smooth arch and then proceeds to an end as in the embodiment described above. In this, the flange would comprise more or less one-half the length of element 20 in FIG. 2, followed by elements 26 and 28.

The foregoing embodiments relate to exemplary configurations of the invention to achieve the shielding of the mouth, from insects, pollen and particulates, for various extents to which a mouth may be opened; modifications may be made without departing from the spirit and scope of the invention. Further, although the foregoing embodiments are illustrative of a device for shielding from insects and airborne particulates a mouth that is open in various extents, it will be understood that the screen of present invention may employ various fillers or dust screens, in addition to or instead of, as would be clear to those knowledgeable in the art.

Figure 5:
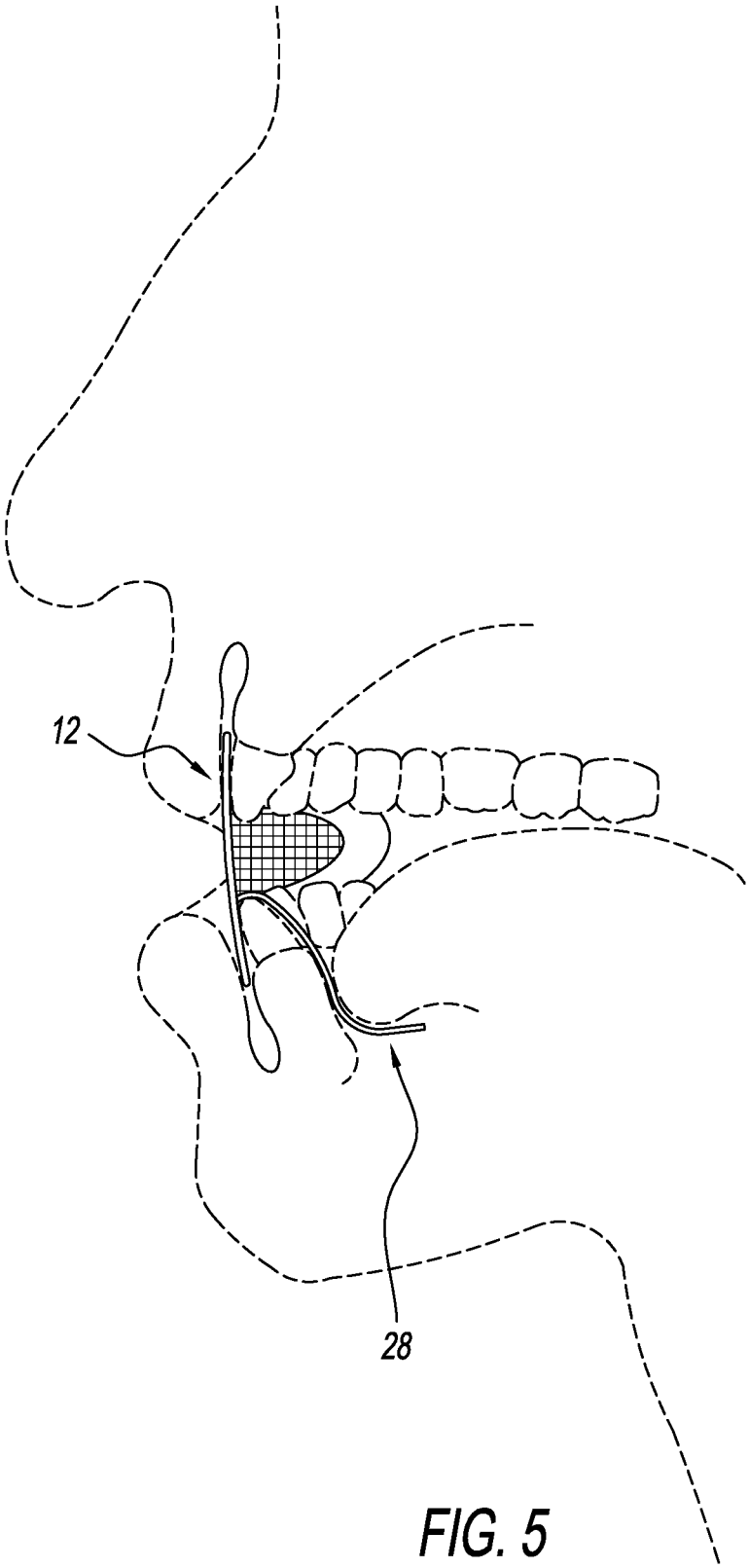
FIG. 5 is a cut away view showing the in-mouth filter of FIG. 1 seated in the mouth.
Figure 6:
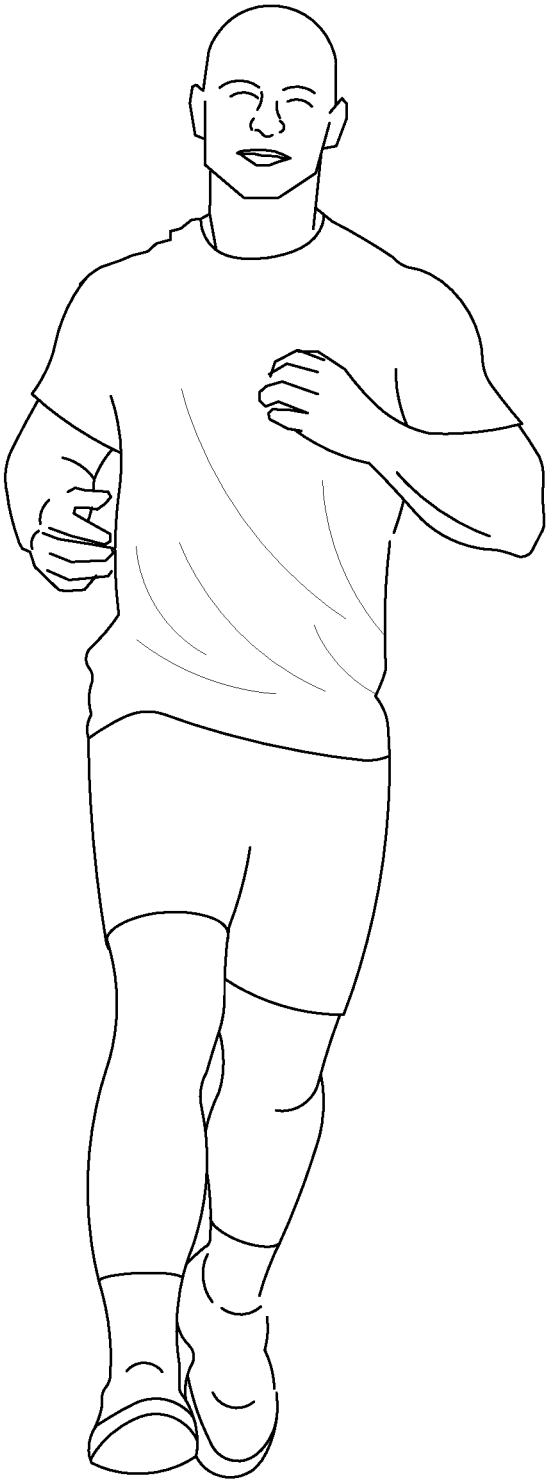
FIG. 6 is a front view of the mouth when the in-mouth filter of FIG. 1 is seated in the mouth and the mouth is closed.
Figure 7:
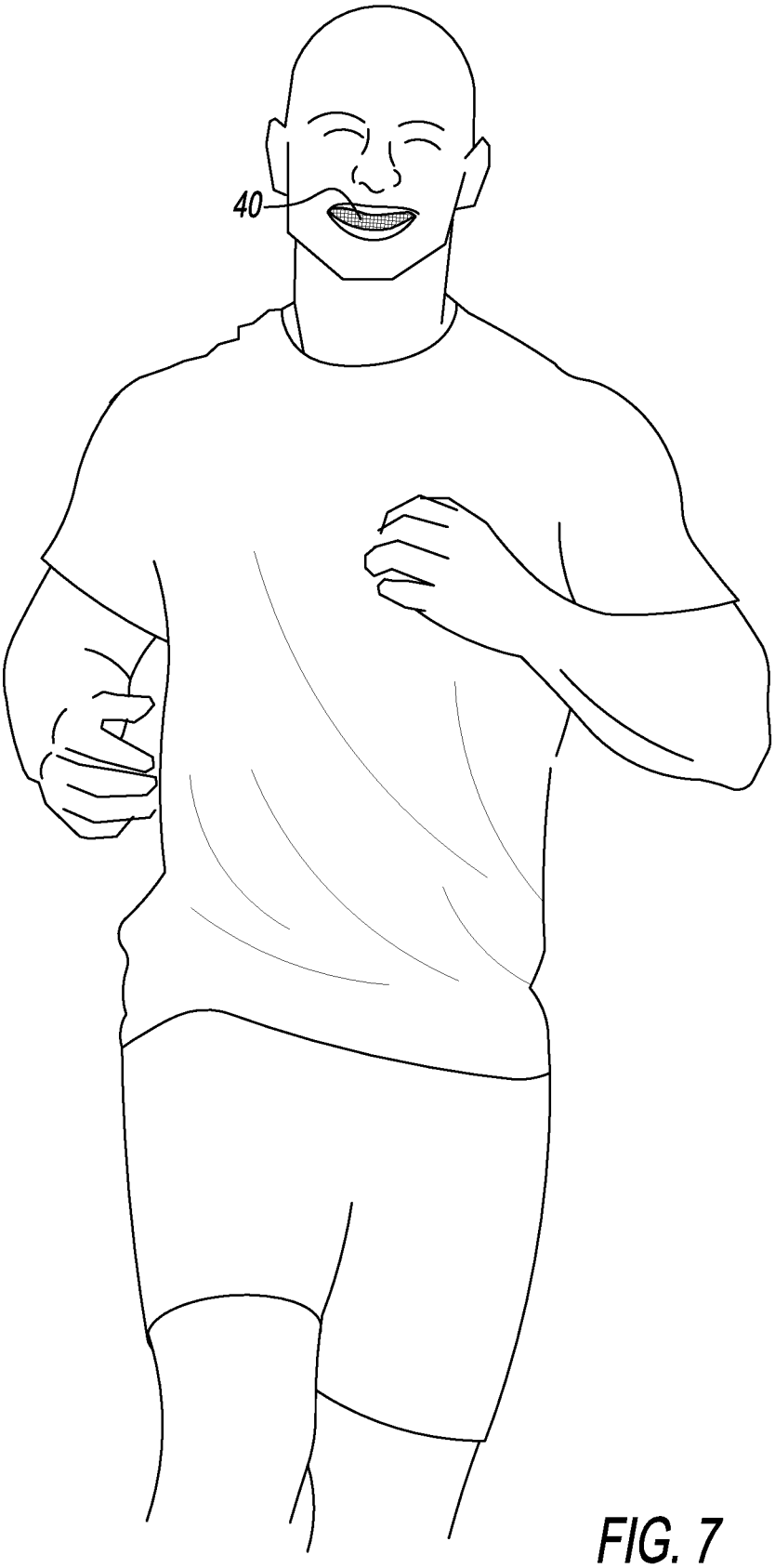
FIG. 7 is a front view of the mouth when the in-mouth fitter of FIG. 1 is seated in the mouth and the mouth is open.

Referring to FIG. 5, the user places the in-mouth filter 10 in front of the teeth but just inside the lips, with the flange 16 lying over the central and lateral mandibular incisors while the distal end 28 of the flange 16 lies under the tip of the tongue. The frame 12 is then bent if not already formed to conform to the contour of the dental arches and gums. In this manner, the piece extends into the buccal folds superiorly and interiorly of the cheek. The flange 16, which is now inwardly projecting, lies on the mandibular incisors and prevents the in-mouth fitter from sliding lower. The distal end 28 of the flange rests under the tip of the tongue so the in-mouth filter does not slide higher when the mouth is opened wider. In this manner, the user's mouth may be closed or agape and the in-mouth filter remains in position; FIG. 5 is a sideview of a user wearing the in-mouth filter. The curve introduced by the bending prevents lateral displacement of the in-mouth filter. The two rows of teeth, lips, cheeks, and tongue cooperate in keeping the in-mouth fitter aligned with the opening of the open mouth in a facile manner so that the in-mouth filter is comfortable and neither the whole nor a part of it is visible to onlookers when the mouth is closed, takes no attention from the wearer, attracts no attention, and prevents insects and particles from entering the open mouth. FIG. 6 shows a user with mouth closed. When the mouth is open, the device is barely visible. FIG. 7 shows a user with mouth open and the screen 40 made of a material of color that stands out, which is not the preferred color for the material for the screen. The screen 14 of FIG. 1 may be made of either mesh or surfaces with holes, having mesh and hole size preferably less than 6 microns so that all pollens are prevented from entering the mouth.

In more detail, still referring to FIG. 1, the indentation 30 on both long edges of the frame 12 ensures that the frame, while seated in the mouth, does not dig into the inferior labial frenulum and the superior labial frenulum. Likewise, the indentation 32 on the distal end 28 of the flange 16 prevents the distal end 28 from digging in to the lingual frenulum.

Figure 4:
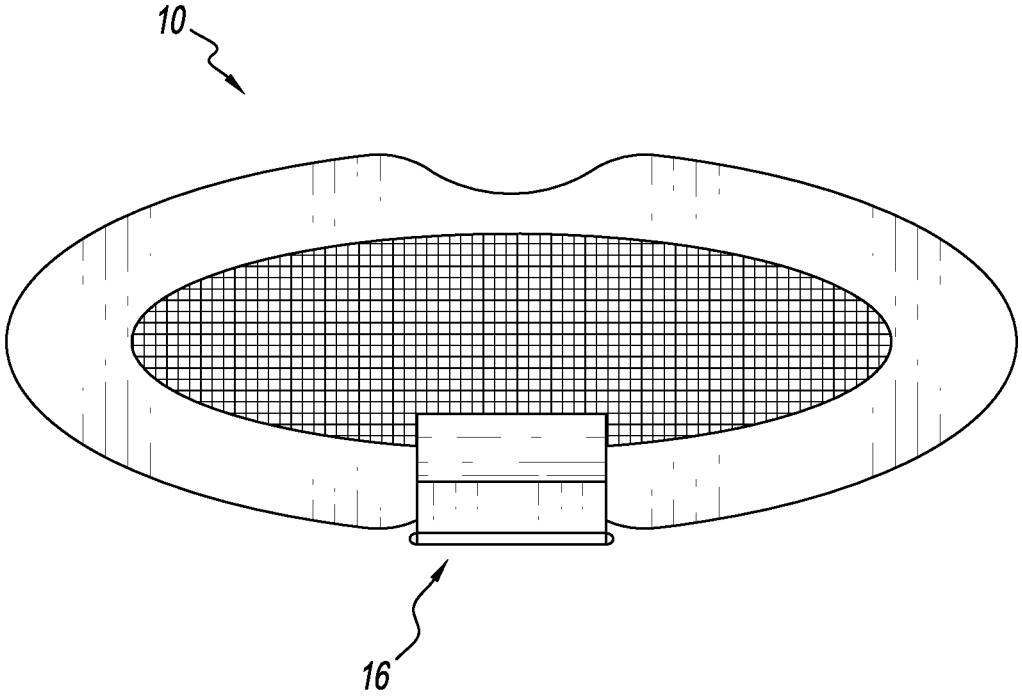
FIG. 4 is a back view of the in-mouth filter of FIG. 1.

The advantages of the present invention include, without limitation, the function that the mouth can be open with various gaps and still remain covered by the screen; this is necessary in prolonged athletic activity since the natural tendency is not for the mouth to be open with a fixed gap. Referring to FIG. 5, the tip of the tongue rests on the distal end 28 of the flange 16. Again, referring to FIG. 4, the frame 12 is not fixed in any manner to the upper teeth. Instead, the frame 12 is held firmly by the tongue and the mandibular incisors and the frame 12 has free play over the front of the upper teeth. This is what allows the mouth to be open with various gaps and fully shielding the mouth by filtering all air inhaled through the mouth. Another important aspect of the present invention is that even when the mouth is closed, the in-mouth filter frame stays in position in the vestibule and the flange under the tongue without discomfort. Still another important aspect of the invention is that the device is not obtrusive or noticeable by virtue of it being seated inside the lips and the lips having to be open only ½ inch, more or less, during the hard breathing. Yet another advantage is that, by virtue of the absence of constraint to open the mouth to any extent, the user can engage in intelligible vocalization. Still another advantage of the present invention is that, by virtue of the frame of the device covering both the upper and lower teeth, the teeth are less prone to damage from impulsive forces such as occurs when the face hits ground or a hard object; this advantage is greater when the frame is rigid as when it is produced by pre-forming to the general user's digital arches and gums.

In broad embodiment, the present invention is an in-mouth filter which is an in-mouth insect screen that prevents insects and particulates from entering an open mouth regardless of how 'wide' the mouth is open during strenuous exercise, 'wide' meaning the distance from the incisel edge of the maxillary central incisors to the incisal edge of the mandibular central incisors at the midline. In this respect, the device for filtering breathed air according to the present invention substantially departs from the conventional concepts and designs of the prior art, and in doing so provides an apparatus primarily developed for the purpose of preventing insects and particulates from riding or flowing in to an open mouth.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. One such variation comprises the lower frame being a bite guard and the flange and other elements remaining more or less the same in dimensions and shapes; in such an embodiment or elsewhere, the flange instead of being integral to the lower frame may be removably coupled to the lower frame so that a formable frame with a removable flange would allow the coupling of a flange from a choice of flange sizes. The invention should therefore not be limited by the above described embodiments, method, and examples, but by all embodiments and methods within the scope and spirit of the invention.

The invention claimed is:

1. An apparatus for filtering breathing air comprising:

a frame comprising a front and a rear, the frame dimensioned and configured to be positioned entirely inside the mouth of a user between the teeth and lips of the user, the frame comprising a central opening;

a filter covering an entirety of the central opening of the frame; and a flange extending from the rear of the frame on a bottom portion thereof and comprising two bends;

wherein the bends in the flange are configured such that the flange extends above the user's mandibular incisors before extending downward behind the mandibular incisors and then extending rearward for being located below the user's tongue during use in order to hold the apparatus in place.

2. The apparatus of claim 1, further comprising a hole in the flange configured to accommodate a tip of the tongue during use.

3. The apparatus of claim 1, wherein the frame is curved to conform to a dental arch of the user.

* * * * *